US006983803B2

(12) United States Patent
Watson et al.

(10) Patent No.: US 6,983,803 B2
(45) Date of Patent: Jan. 10, 2006

(54) EQUALIZER VALVE AND ASSOCIATED METHOD FOR SEALING A FLUID FLOW

(75) Inventors: Richard R. Watson, Missouri City, TX (US); Preston N. Weintraub, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 127 days.

(21) Appl. No.: 10/440,637

(22) Filed: May 19, 2003

(65) Prior Publication Data

US 2004/0000762 A1 Jan. 1, 2004

Related U.S. Application Data

(60) Provisional application No. 60/381,419, filed on May 17, 2002.

(51) Int. Cl.

| | |
|---|---|
| ***E21B 34/10*** | (2006.01) |
| ***E21B 47/00*** | (2006.01) |
| ***F16K 31/122*** | (2006.01) |

(52) U.S. Cl. ..... 166/374; 166/250.02; 166/324; 166/332.7; 251/31

(58) Field of Classification Search ..... 166/250.02, 166/250.1, 319–321, 324, 332.7, 374–375; 251/31, 176; 137/625.66

See application file for complete search history.

(56) References Cited

U.S. PATENT DOCUMENTS

| | | | | |
|---|---|---|---|---|
| 1,619,328 A | | 3/1927 | Benckenstein | |
| 2,313,369 A | * | 3/1943 | Lloyd | 175/4.52 |
| 2,417,494 A | | 3/1947 | Hoof | |
| 2,585,863 A | * | 2/1952 | Smith | 137/859 |
| 2,978,046 A | | 4/1961 | True | |
| 3,661,167 A | | 5/1972 | Hussey | |
| 3,913,609 A | * | 10/1975 | Remane | 137/322 |
| 4,011,892 A | * | 3/1977 | Kowalski | 137/625.66 |
| 4,053,544 A | * | 10/1977 | Moore | 261/145 |
| 2,959,188 A | | 11/1980 | Kepner | |
| 4,387,736 A | | 6/1983 | Major | |
| 4,406,335 A | | 9/1983 | Koot | |
| 4,513,778 A | | 4/1985 | Vadasz | |
| 4,615,399 A | | 10/1986 | Schoeffler | |
| 3,335,750 A | | 8/1987 | Kepnerz | |
| 4,745,802 A | | 5/1988 | Purfurst | |
| 4,844,414 A | | 7/1989 | Sable et al. | |
| 4,848,218 A | | 7/1989 | Battaglia | |
| 4,898,236 A | | 2/1990 | Sask | |

(Continued)

FOREIGN PATENT DOCUMENTS

| | | |
|---|---|---|
| EP | 0 697 501 A2 | 2/1996 |
| WO | WO 01/33044 A1 | 5/2001 |
| WO | WO 01/33045 A1 | 5/2001 |

OTHER PUBLICATIONS

M. Hooper, "Applications for an LWD Formation Tester," SPE 52794; May–Jun. 1999; 8 pages.

*Primary Examiner*—David Bagnell
*Assistant Examiner*—B. D. Halford
(74) *Attorney, Agent, or Firm*—Conley Rose, P.C.

(57) ABSTRACT

A dirty fluid valve for sealing high differential fluid pressures in a drilling environment and methods for using such a valve is disclosed. One embodiment of the valve includes a seal cartridge having several openings for directing a fluid path through the cartridge, a spring connected at one end of the seal cartridge and extending through the fluid path, and a seal member connected to the other end of the spring. The seal is actuatable between an open position and a closed position so that it covers one of the openings in the seal cartridge when it is in the closed position, thereby sealing off the fluid flow through the seal cartridge fluid path. The spring provides a pre-loading force to the seal member so that the seal member always has sufficient contact with the surfaces surrounding the opening that the seal covers.

48 Claims, 5 Drawing Sheets

U.S. PATENT DOCUMENTS

| | | | | | |
|---|---|---|---|---|---|
| 4,901,754 | A | | 2/1990 | Sable et al. | |
| 4,945,945 | A | | 8/1990 | Schmid | |
| 5,074,758 | A | | 12/1991 | McIntyre | |
| 5,101,907 | A | | 4/1992 | Schultz et al. | |
| 5,230,244 | A | | 7/1993 | Gilbert | |
| 5,329,811 | A | | 7/1994 | Schultz et al. | |
| 5,337,826 | A | | 8/1994 | Barrington | |
| 5,443,129 | A | | 8/1995 | Bailey et al. | |
| 5,473,939 | A | | 12/1995 | Leder et al. | |
| 5,540,280 | A | | 7/1996 | Schultz et al. | |
| 5,771,931 | A | * | 6/1998 | Watson | 137/625.66 |
| 5,797,426 | A | | 8/1998 | Powell | |
| 5,799,733 | A | | 9/1998 | Ringgenberg et al. | |
| 5,803,186 | A | | 9/1998 | Berger et al. | |
| 5,826,657 | A | | 10/1998 | Ringgenberg | |
| 5,901,796 | A | | 5/1999 | McDonald | |
| 5,911,285 | A | | 6/1999 | Stewart et al. | |
| 5,921,271 | A | | 7/1999 | Thomas et al. | |
| 5,979,572 | A | | 11/1999 | Boyd et al. | |
| 6,006,834 | A | | 12/1999 | Skinner | |
| 6,047,239 | A | | 4/2000 | Berger et al. | |
| 6,157,893 | A | | 12/2000 | Berger et al. | |
| 6,176,692 | B1 | * | 1/2001 | Reinartz et al. | 417/454 |
| 6,189,612 | B1 | | 2/2001 | Ward | |
| 6,230,811 | B1 | | 5/2001 | Ringgenberg et al. | |
| 6,279,654 | B1 | | 8/2001 | Mosing et al. | |
| 6,341,618 | B1 | | 1/2002 | Ricci | |
| 6,520,478 | B1 | | 2/2003 | Hope et al. | |
| 6,581,455 | B1 | | 6/2003 | Berger et al. | |
| 6,702,024 | B2 | * | 3/2004 | Neugebauer | 166/321 |
| 2003/0111227 | A1 | | 6/2003 | Neugebauer | |

* cited by examiner

EQUALIZER VALVE AND ASSOCIATED METHOD FOR SEALING A FLUID FLOW

CROSS-REFERENCE TO RELATED APPLICATIONS

The present application claims the benefit of U.S. Provisional Application Ser. No. 60/381,419, filed May 17, 2002, entitled Equalizer Valve, which is hereby incorporated herein by reference.

STATEMENT REGARDING FEDERALLY SPONSORED RESEARCH OR DEVELOPMENT

Not applicable.

BACKGROUND OF THE INVENTION

1. Field of the Invention

The present invention relates to oil and gas well drilling systems. More particularly, the present invention relates to fluid valves used to regulate or control fluid flows and pressures in a downhole environment. In one aspect, the present invention relates to an equalization valve used for sealing high differential pressure in a drilling environment during ancillary drilling operations.

2. Background of the Invention

During the drilling and completion of oil and gas wells, the downhole environment tends to be harsh and unforgiving. These harsh conditions include vibration and torque from the drill bit, exposure to drilling mud, drilled cuttings, and formation fluids, hydraulic forces of the circulating drilling mud, and scraping of sensitive equipment against the sides of the wellbore. Extreme pressures and temperatures are also present. Such harsh conditions can damage and degrade portions of the drill string, especially the equipment found in various tool strings.

Generally the drilling fluid flow is downward through the inner flow bore of the drill string, out through the drill bit, and back up through the annulus formed between the drill string and the borehole wall. However, often times it is required that the fluid flow, or portions thereof, be diverted, whether the fluid flow is found in the inner flow bore or in the annulus. For example, portions of the fluid flow may be diverted to provide hydraulic power to an independent system within the drill string, such as a packer module, to maintain continuous circulation of the drilling mud when primary drilling operations have been temporarily stopped, or to create or equalize a pressure drop between certain zones in the downhole environment. To achieve diversion of the fluid flow, particularly the fluid flow in the annulus, various valves have been developed.

Valves used in drilling operations are inherently susceptible to the harsh downhole conditions because they require the use of seals and moving parts. Valves that interact with the drilling mud flow are especially susceptible to the drilling mud, the deleterious debris carried by the drilling mud, and significant pressure drops. Unlike valves contained in closed systems, which typically interact only with a clean hydraulic oil, valves that interact with well fluids, called "dirty" fluid valves, are necessarily exposed to greater wear and degradation. The debris contained in well fluids tend to damage traditional valves using elastomeric seals. Thus, dirty fluid valves must be designed differently in order to compensate for their exposure to the debris in well fluids.

Often dirty fluid valves are exposed to the drilling environment because they are needed to create or diffuse a differential pressure between the drilling environment and some system that has been closed off from the drilling environment. This type of valve is typically called an equalizer valve. The function of the equalizer valve is to either isolate or connect the annulus of the borehole with a flowline of the valve internal to the drill string. When the annulus is isolated from the internal flowline, a significant pressure drop is created on the order of thousands of psi's. If the default position of the valve is to connect the annulus with the internal flowline, then the valve is considered normally open. If the default position is isolation, then the valve is considered normally closed.

Because the pressure differential is so great when the annulus is isolated from the internal flowlines of the drill string, valve and other seals are susceptible to blow-out and rapid degradation. Thus, equalizer valves are used to balance the pressure differentials. In order to reduce the wear on the seals, these valves are often normally open-type valves (connecting the annulus with internal flowlines). Despite being normally open, equalizer valves remain inherently susceptible to the abrasive nature of the well fluids that the valves interact with. Thus, the industry would welcome a reliable, normally open, dirty fluid valve for sealing high differential pressure in a drilling environment which is also field replaceable without disturbing the hydraulics circuit or other structure used to actuate the valve.

BRIEF SUMMARY OF SOME OF THE PREFERRED EMBODIMENTS OF THE INVENTION

The preferred embodiments of the present invention include a dirty fluid valve for sealing high differential fluid pressures in a drilling environment, and methods for using such a valve. One embodiment of the valve includes a seal cartridge having several openings for directing a fluid path through the cartridge, a spring connected at one end of the seal cartridge and extending through the fluid path, and a seal member connected to the other end of the spring. The seal is actuatable between an open position and a closed position so that it covers one of the openings in the seal cartridge when it is in the closed position, thereby sealing off the fluid flow through the seal cartridge fluid path. The spring provides a pre-loading force to the seal member so that the seal member always has sufficient contact with the surfaces surrounding the opening that the seal covers. The spring also has a snap action for assisting with crisp movement between the open and closed positions. The spring and seal member combination cause a shear seal which is leak-free in a dirty fluid environment.

In another embodiment of the valve, the seal cartridge includes several opposing rod members that are reciprocally disposed within bores adjacent the seal member. The rod members contact the seal member, and can be moved back and forth to actuate the seal member between the open and closed positions.

In yet another embodiment of the valve, the valve includes a reciprocating sleeve member supported by the housing of a tool string. The sleeve member includes an aperture having an inner surface. The seal cartridge is place into the aperture, transverse to the longitudinal axis of the sleeve member and the tool string. The housing receives the seal cartridge via a radial bore. The outer portions of the rod members contact opposite ends of the inner surface of the sleeve member aperture. The sleeve member is hydraulically actuatable back and forth, thereby pushing the rod members and actuating the seal member between the open and closed positions. Use of the sleeve member to actuate the seal member allows the seal cartridge to be field replaceable without perturbing the hydraulic system.

A preferred embodiment of the method of the present invention includes directing a fluid flow through a seal cartridge; supporting a spring such that the spring extends into the fluid flow; pre-loading a seal member using the spring; and actuating the seal member between an open position and a closed position, where the fluid is allowed to flow through the seal cartridge when the seal member is in the open position and the fluid is sealed when the seal member is in the closed position.

Another embodiment includes disposing the seal cartridge within an aperture formed in a sleeve member, the aperture comprising an inner surface; engaging the inner surface of the aperture with the seal member; and actuating the sleeve member between an open position and a closed position, thereby actuating the seal member.

A further embodiment includes raising the seal cartridge to the surface of a wellbore and replacing the seal cartridge with a new seal cartridge at the surface of the wellbore.

These and other advantages and advances provided by the various embodiments of this invention will be readily apparent to those skilled in the art upon a review of the specification and drawings which follow.

NOTATION AND NOMENCLATURE

Figure 1:
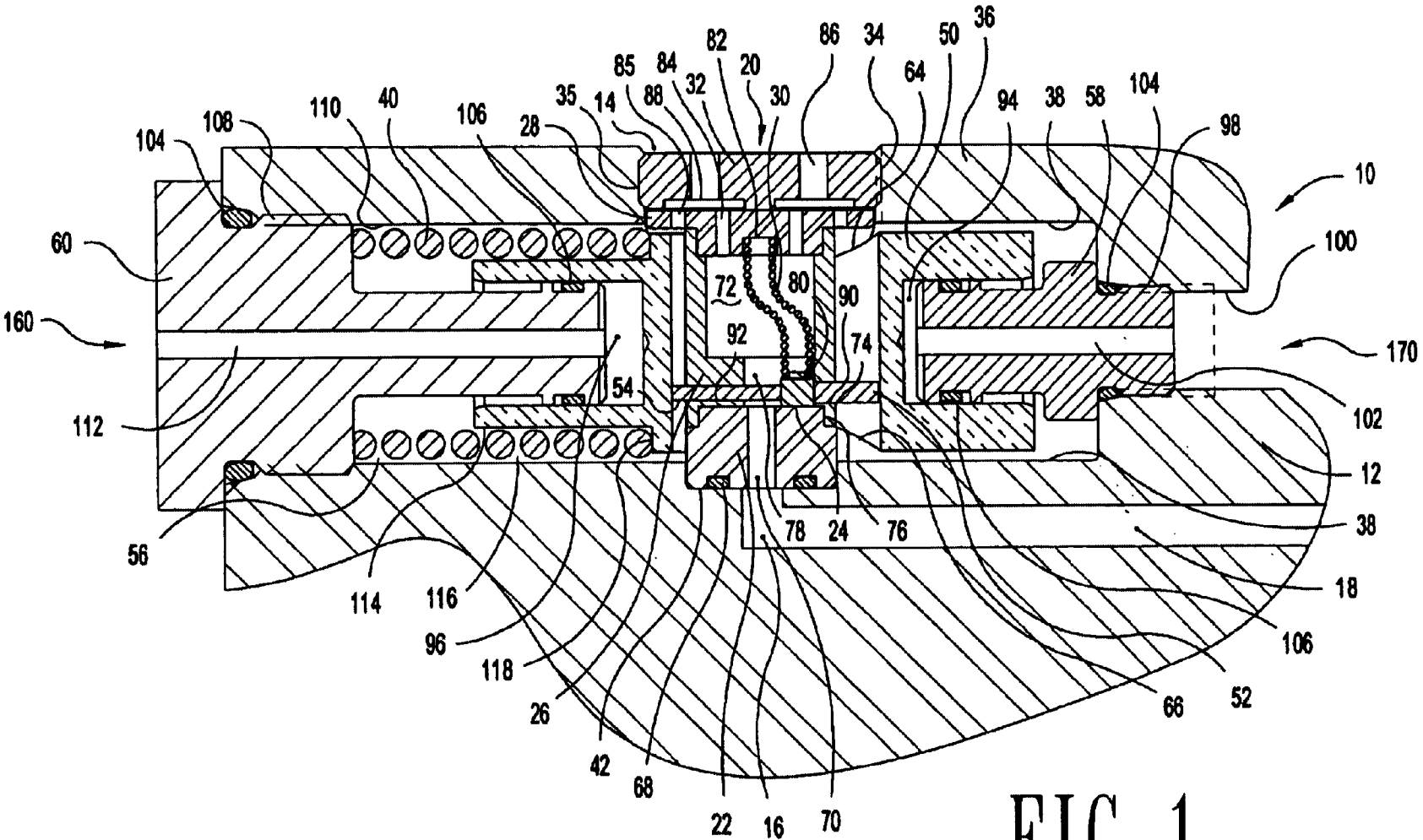
FIG. 1 is a cross-section view of the equalizer valve in an open position.

Certain terms are used throughout the following description and claims to refer to particular system components. As one skilled in the art will appreciate, one skilled in the art may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ". In addition, reference to up or down will be made for purposes of description with "up," "upward," or "upper" meaning toward the surface of the well and "down," "downward," or "lower" meaning toward the bottom of the primary wellbore or any lateral borehole. Furthermore, the term "couple" or "couples" is intended to mean either an indirect or a direct connection. Thus, if a first device couples to a second device, that connection may be through a direct connection, or through an indirect electrical connection via other devices and connections.

This exemplary disclosure is provided with the understanding that it is to be considered an exemplification of the principles of the invention, and is not intended to limit the invention to that illustrated and described herein. In particular, various embodiments of the present invention provide a number of different constructions and methods of operation. It is to be fully recognized that the different teachings of the embodiments discussed below may be employed separately or in any suitable combination to produce desired results.

DETAILED DESCRIPTION OF THE PREFERRED EMBODIMENTS

Referring initially to FIGS. 1–4, the valve 10 includes a sealing assembly or cartridge 20 and an actuator assembly 40 mounted in a housing 12. The longitudinal axis of the actuator assembly 40 goes from left to right in FIG. 1 while the longitudinal axis of the sealing assembly 20 goes from top to bottom and is transverse to the longitudinal axis of the actuator assembly 40. The housing 12 includes a first port 14 whose longitudinal axis generally coincides with the longitudinal axis of the sealing assembly 20. The port 14 communicates with a fluid under pressure and a second port 16 communicating with a passageway 18. The valve 10 controls communication of fluid from the first port 14 to the second port 16 by opening and closing that communication to fluid flow.

The sealing assembly 20 includes a seal plate 22, a seal 24, a cage 26, a spring cap 28, a seal spring 30, a plug 32, a close push rod 52, and an open push rod 54. The sealing assembly 20 forms a field replaceable seal cartridge which is disposed in through an aperture 34 in the wall 36 of the housing 12, across a cylindrical bore 38 in the housing 12 and into a counterbore 42. The longitudinal axis of aperture 34 generally coincides with those axes of the port 14 and the sealing assembly 20. The cylindrical bore 38 is transverse to the axis of the aperture 34 and the counterbore 42 which are co-axial. The plug 32 and the aperture 34 are threaded at 35 to removably connect the seal cartridge 20 to the housing 12.

Figure 4A:
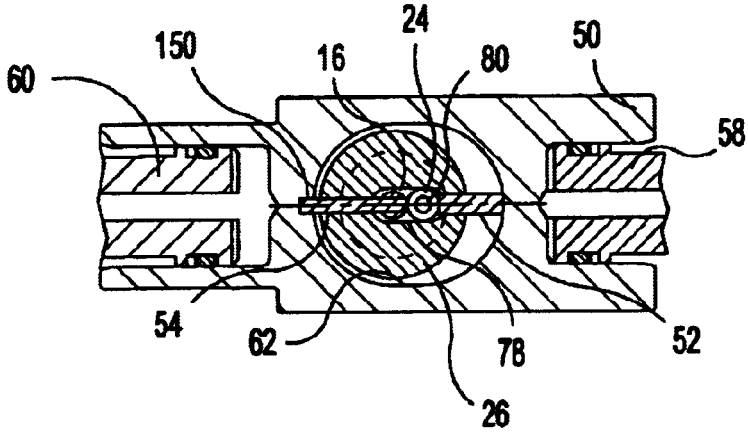
FIG. 4A is a cross-section view of the valve of FIG. 2 taken along the plane 2—2.
Figure 4B:
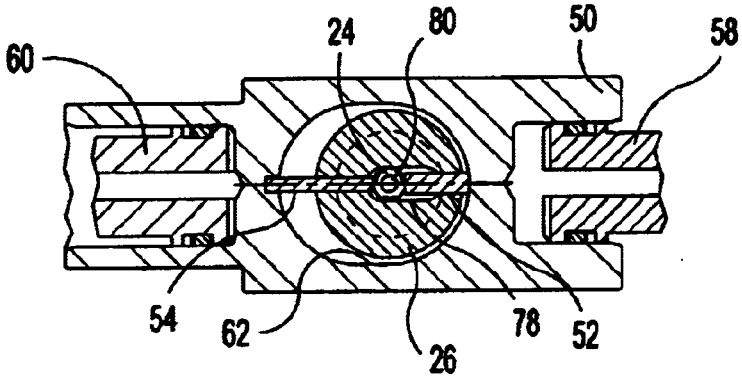
FIG. 4B is the valve of FIG. 4A in a closed position.

The actuator assembly 40 includes a slide member 50, a return spring 56, a close piston 58, and an open piston 60. As best shown in FIGS. 1, 4A and 4B, the slide member 50 includes a slotted aperture 62 therethrough with first and second arcuate edges 64, 66, respectively, adjacent the aperture 34 and the counterbore 42, respectively. The slotted aperture 62 is an oblong hole in the slide member 50. The first and second arcuate edges 64, 66, respectively, are formed as the result of cutting the slotted aperture 62 through the cylindrical body of the slide member 50. The actuator assembly 40 is disposed within the cylindrical bore 38 as hereinafter described in further detail. The sealing assembly 20 extends through the slotted aperture 62 between the aperture 34 and the counterbore 42.

Referring particularly to FIG. 1, the seal plate 22 is received within the counterbore 42 and is sealed to the bottom of the counterbore 42 by the seal members 68, such as o-rings. The seal plate 22 has a sealing surface on the side opposite seal members 68. The seal plate 22 includes a fluid passage 70 extending therethrough communicating with the second port 16. Cage 26 is generally cup shaped forming a cavity 72 and has an annular flange 74 extending around a reduced diameter end 76 of the seal plate 22. An offset slotted hole 78, having side and end walls, extends through the bottom of the cage 26. The seal plate fluid passage 70 communicates with the cavity 72 via the slotted hole 78.

The seal 24 is a solid cylindrical shaped member having a tang 80 extending from one end and a sealing surface on the other end. The seal 24 has a diameter slightly greater than the diameter of the mouth of the seal plate fluid passage 70, whereby when the seal 24 is centered on the passage 70, the sealing surface of the seal 24 seals with the sealing surface of the seal plate 22 to prevent flow through the passage 70 and the valve 10. The seal 24 reciprocates in the slotted hole 78 in the bottom of the cage 26. The side walls of the slotted hole 78 maintain the seal 24 in alignment with the passage 70 during reciprocation while the end walls serve as stops to the reciprocal movement of the seal 24 in the slotted hole 78.

The close push rod 52 and open push rod 54 are reciprocably housed in bores 90, 92, respectively, through the sides of the cage 26. The close push rod 52 has a larger cross-section than the open push rod 54 so that the push rods cannot be assembled incorrectly. The push rod 54 is captured within slot 150 in the slide member 50; the close push rod 52, having a larger cross-section, cannot fit in the slot 150. The push rods 52, 54 are positioned to be in alignment with the seal 24 such that the inner ends of the rods 52, 54 bear against the seal 24 and the outer ends of rods 52, 54 bear against the end walls of the slide member 50 formed by the slotted aperture 62. This positioning ensures that as the slide member 50 shifts axially, the rods 52, 54 also shift axially and the seal 24 is moved between the open and closed positions. The slide member 50 acts as a shuttle piston. Each end of the slide member 50 includes a cylinder 94, 96, respectively. Close piston 58 and open piston 60 are received within cylinders 94, 96, respectively, and are stationary members affixed to the housing 12. Seals 104 are provided between the pistons 58, 60 and the housing 12, and seals or O-rings 106 are provided between the pistons 58, 60 and the walls of the cylinders 94, 96, respectively.

The spring cap 28 includes a reduced diameter portion which is received in a counterbore in the open end of the cage 26 to affix the cage 26 to the cap 28. A plurality of fluid passageways 84, 85 extend through the spring cap 28. A spring retaining bore 82 is centered on the reduced diameter portion and receives one end of the seal spring 30 with the other end of the seal spring 30 receiving the tang 80 projecting from the seal 24.

The plug 32 is a disc-like member which is threadingly received by the threaded aperture 34 and which bears against the spring cap 28 to maintain the spring assembly, i.e., the seal cartridge 20, in the housing 12. The plug 32 includes a plurality of passages 86 therethrough to communicate the port 14 with the passageways 84, 85 in the spring cap 28 and the cavity 72 in the cage 26. The inner side of the passages 86 are enlarged at 88 to ensure alignment and fluid communication between passages 86 and passageways 84 and 85. It should be appreciated that fluids may flow through the passages 85 around the outside of the cage 26 and through the slotted aperture 62, and that fluids may pass into the cylindrical bore 38.

The close piston 58 is threadingly connected to the housing 12 at threads 98 in a threaded bore 100 in the housing 12. The bore 100 is a hydraulic port which communicates with a supply of hydraulic fluid 170. The close piston 58 also includes an aperture 102 therethrough communicating with the hydraulic port 100 such that the close cylinder 94 may be pressurized to hydraulically actuate the slide member 50 to the closed position.

The open piston 60 is threadingly connected to the housing 12 at threads 108 in a threaded bore 110 in the housing 12. The open cylinder 96 is a hydraulic chamber which communicates with a supply of hydraulic fluid 160 via fluid passageway 112. The open cylinder 96 may be pressurized to hydraulically actuate the slide member 50 to the open position. The open cylinder end of the slide member 50 has a reduced diameter portion 114 to form a spring annulus to house the return spring 56. The return spring 56 bears against the stationary open piston 60 at one end, and against an annular shoulder 118 formed by the reduced diameter portion 114 at the other end. Preferably the return spring 56 will return the slide member 50 to the open position upon the reduction of fluid pressure in the close cylinder 94. Hydraulic pressure via the hydraulic supply 160 through the fluid passageway 112 in the open cylinder 96 is preferably used to assist return spring 56 when needed. A return spring has only been provided on one side of the slide member 50 because the valve 10 is normally open. The valve 10 may be hydraulically actuated in both directions, but is normally open. Alternatively, the valve 10 can be constructed so that it operates as a normally closed valve.

Operation of the Valve

Referring now to FIG. 1, the valve 10 is shown in the open position with the slide member 50 being shifted all the way to the right by the return spring 56. With the slide member 50 to the right, the cylinder 96 is enlarged and the open push rod 54 has pushed the seal 24 to the right and clear of the passage 70 in the seal plate 22. This configuration opens the passageway defined by the port 14, the passages 86, the passageways 84, 85, the cavity 72, the slotted hole 78, the passage 70, and the second port 16 to the passageway 18. The threads 98, 108 maintain the pistons 58, 60, respectively, in a stationary position as the sleeve member 50 with the cylinders 94, 96 shuttles the seal 24 back and forth in response to hydraulic fluid forces applied either through the fluid passageway 102 or the passageway 112.

Figure 5:
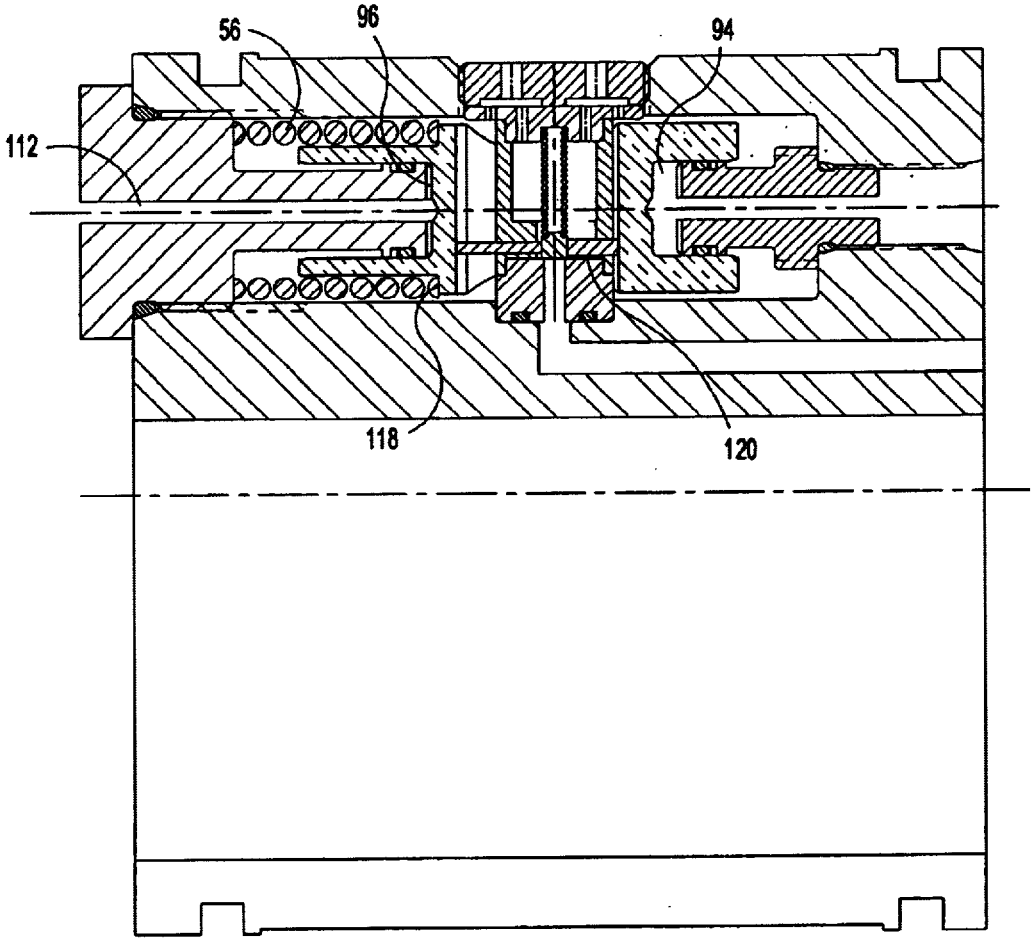
FIG. 5 is the valve of FIG. 2 in a closed position.

Referring now to FIG. 5, the fluid in the bore 100 is pressurized via hydraulic fluid from the hydraulic supply 170 through the passageway 102 until the pressure on the bottom of the cylinder 94 overcomes the force of the return spring 56 on the shoulder 118 as well as the force due to friction caused by O-rings 106 on pistons 58 and 60 as seen in FIG. 1. The slide member 50 then moves to the left with the close push rod 52 forcing the seal 24 to slide across the sealing surface 120 of the seal plate 22. The rod 52 pushes the seal 24 from the open position shown in FIG. 1 to the closed position shown in FIG. 5. The seal 24 is pressed against the seal plate 22 by the seal spring 30. As the slide member 50 moves to the left, the return spring 56 is compressed as shown in FIG. 5.

To reopen the valve 10, the hydraulic pressure in the bore 100 is reduced. The return spring 56 then de-compresses to move the slide member 50 back to the right. In addition, hydraulic fluid from hydraulic supply 160 is supplied through the passage 112, and the pressure acts on the bottom shoulder of the cylinder 96 to assist the movement of slide member 50 back to the right. In the case where spring 56 fails to open the valve 10, this secondary hydraulic supply 160 will act to close valve 10.

Figure 2:
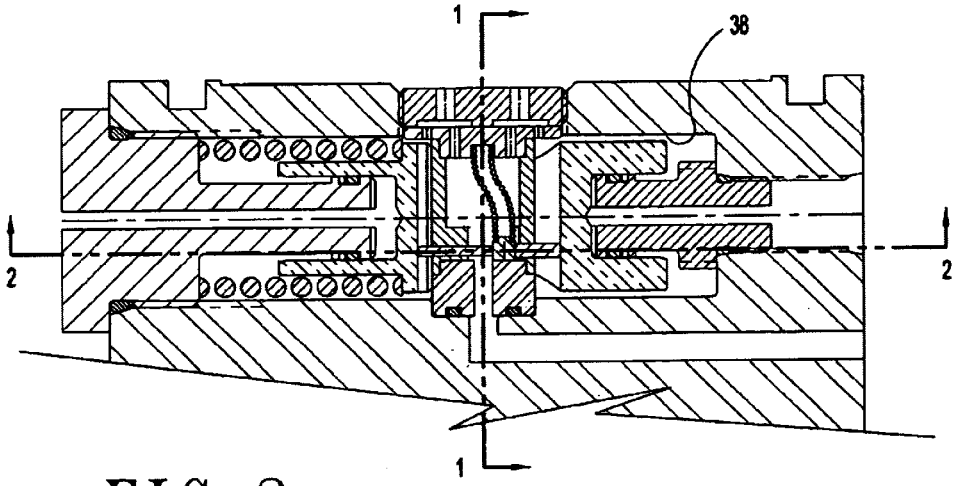
FIG. 2 is an additional cross-section view of the equalizer valve of FIG. 1.
Figure 3:
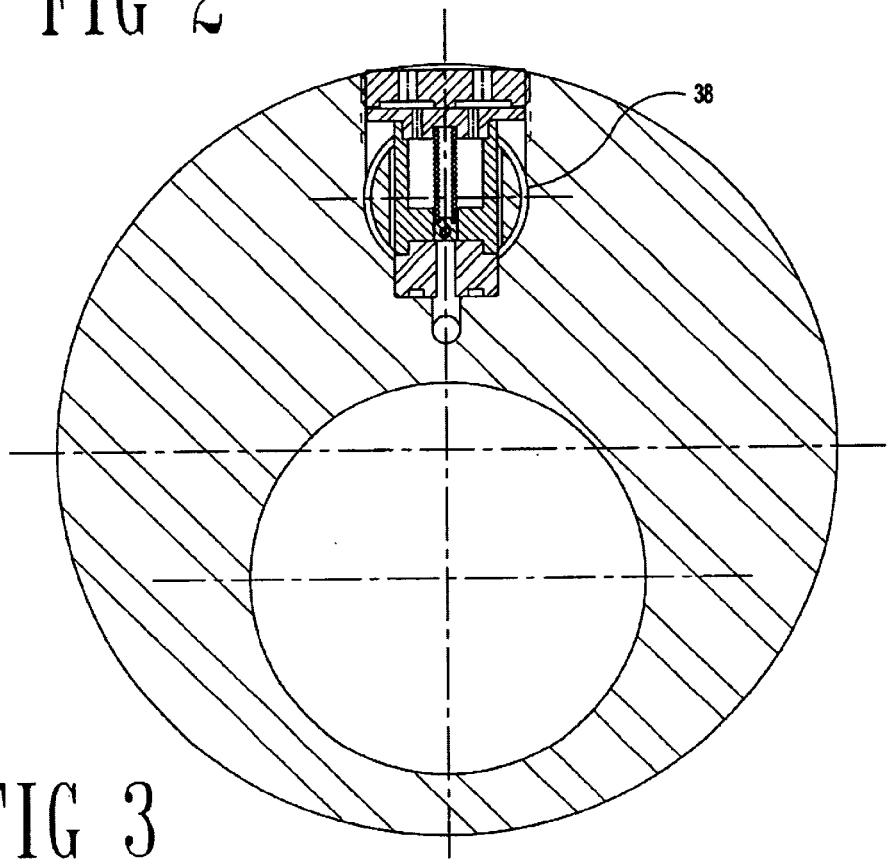
FIG. 3 is a cross-section view of the valve of FIG. 2 taken at the plane 1—1.

In the closed position shown in FIG. 3, the seal spring 30 is straight and cylindrical, and in the open position shown in FIGS. 1 and 2, the seal spring 30 is deformed whereby the ends of spring 30 are no longer co-axial because tang 80 and counterbore 82 are no longer co-axial. The spring 30 is allowed to twist and turn with the movement of the seal 24.

As the actuator assembly 40 shuttles the seal 24 back and forth within the slotted hole 78 and over the mouth of the passage 70, it is important that proper flatness and surface finish are maintained so that there is no leakage past the seal created by the seal 24 and the seal plate 22 when the valve 10 is in the closed position. Thus, the contact surfaces (bottom surface of the seal 24 and top sealing surface 120 of the seal plate 22) are manufactured flat to 2 He lightbands or better. When the seal 24 is shuttled to the closed position, forces from the high pressure annulus fluid column push on the top side of the seal 24 at the tang 80. Consequently, the portions of the seal 24 which overlap the mouth of passage 70 bear down on the seal plate 22, creating what is known as a shear seal.

Although shear seals have been successfully employed in dirty fluid environments, in a preferred embodiment of the present invention the seal spring 30 is present to ensure that a proper shear seal is created. The seal 24 is only connected to the seal spring 30 at the tang 80. It is not connected to the push rods 52, 54 or any of the other structure surrounding the seal 24. Alternatively, the seal 24 could be connected to one or both of the push rods 52, 54, but this would restrain the seal 24 in such a way as to possibly cause an off-axis load or misalignment on the seal 24. An off-axis load on or a misalignment of the seal 24 would prevent the annulus pressure from causing the seal 24 to properly bear down on the seal plate 22, thus preventing a shear seal.

Instead, the seal 24 is restrained only by the seal spring 30. The seal spring 30 continuously provides force to the top of the seal 24 at the tang 80, thereby providing a proper pre-load to the seal 24. A "snap-acting" spring is used for the seal spring 30 to maintain the continuous force on the seal 24 whether the seal 24 is in the open position, closed position, or any position in between. As the seal 24 moves from the open position of FIG. 1 to the closed position of FIG. 5, the seal spring 30 compresses with a snap action. As the seal 24 moves back to the open position, the seal spring also decompresses with a snap action. The snapping action assists the actuator assembly and push rods with crisp movement of the seal 24. However, and more importantly, the snapping characteristic of the seal spring 30 allows the spring to apply the necessary pre-loading forces to the seal 24 despite the spring's contorted or twisted condition in the open position. The pre-loading force is especially important when the seal 24 moves from the open to the closed position.

It should be understood that the valve 10 may be used in any application requiring the sealing of a fluid flow. The valve 10 is particularly useful in oilfield operations and tools. For example, the valve 10 may be used as an equalizer valve in an oilfield tool which communicates with the surrounding annulus in a downhole environment. One such application of the valve 10 is in formation testing. Valve 10 is particularly well suited for use in the formation tester described in provisional patent application Ser. No. 60/381,243 filed May 17, 2002, entitled Formation Tester, and in the patent application filed concurrently herewith via Express Mail No. EV324573681US and entitled MWD Formation Tester, which claims priority to the previously reference provisional application, both applications hereby incorporated by reference herein for all purposes.

The valve 10 can seal dirty fluid (debris laden fluid) leak-free, and may be reopened while there is a pressure differential of up to 8,000 p.s.i. between first port 14 and second port 16. For example, the shear seal provided by valve 10 can be used in a formation test tool that requires a leak-free equalizer valve in an environment containing dirty or debris laden fluid. Valve 10 can also be used in a formation tester that makes formation pressure tests with a pressure differential up to 8,000 p.s.i. between the annulus fluid and the formation fluid in the chamber of the formation tester.

Figure 6:
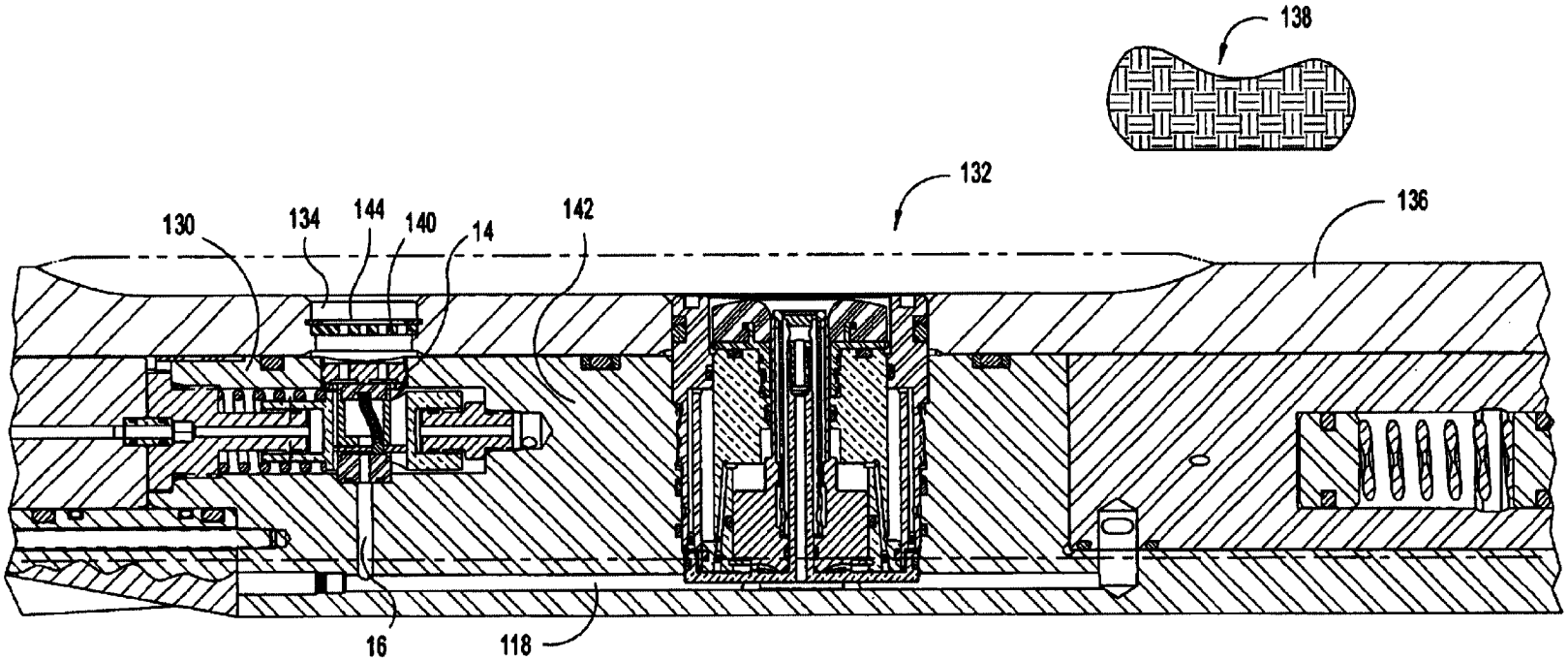
FIG. 6 is a cross-section view of the valve of FIG. 1 in a closed position and disposed a larger formation testing apparatus.

Referring now to FIG. 6, there is shown an application of the valve 10 as an equalizer valve 130 in a formation tester 132. The first port 14 is aligned with an aperture 134 through the wall of the housing 136 of the formation tester 132 such that the port 14 is open to the annulus 138 formed between the formation tester 132 and the wall of the borehole being drilled. The annulus 138 is filled with drilling mud and well fluids which pass through the aperture 134 and into the valve 130 via the port 14. A screen 140 may be placed over the aperture 134 to prevent deleterious debris from passing into the equalizer valve 130. The screen 140 is retained in the housing 136 by retaining ring 144.

The equalizer valve 130 is normally open allowing annulus fluids to flow through the valve 130 from the port 14 to the port 16 and into the passage 118 in the internal member 142. The formation tester 132 includes a motor driving a pump to actuate actuation assembly 40 to move the seal 24 between the open and closed positions. In the case of the formation tester 132, the valve 130 may be closed to allow the formation tester to perform a test.

The seal cartridge 20 is inserted through the aperture 134 of the housing 136 and through port 14 of member 142 that forms part of the internal components of the formation tester 132. As shown in FIG. 6, the internal member 142 is disposed within the housing 136 of the formation tester 132. The cartridge 20 may be replaced in the field if necessary. Referring now to both FIGS. 1 and 6, the threads at 35 of FIG. 1 allow the operator to isolate and remove the seal cartridge 20. First, the operator may remove the screen 140 by removing the retaining ring 144 from the housing 136 and then removing the screen 140. The cartridge 20 can be grabbed by screwing two small screws into the spring cap 28 and lifting the cartridge 20 out of the valve 10. The hydraulic system, including the actuator assembly 40, is unperturbed. When installing a replacement cartridge, the push rods 52, 54 assist the operator with orienting the cartridge 20 properly. As mentioned before, the open push rod 54 is smaller in diameter than the close push rod 52, allowing the operator to align the open push rod 54 with the slot 150 in the slide 50.

Thus the equalizer valve 10 combines shear seal technology with a snap-acting seal design that is field replaceable without disturbing-the hydraulics circuit used to actuate the valve. This design combines performance in a dirty fluid environment with maintainability should a seal failure occur.

The above discussion is meant to be illustrative of the principles and various embodiments of the present invention. While the preferred embodiment of the invention and its method of use have been shown and described, modifications thereof can be made by one skilled in the art without departing from the spirit and teachings of the invention. The embodiments described herein are exemplary only, and are not limiting. Many variations and modifications of the invention and apparatus and methods disclosed herein are possible and are within the scope of the invention. Accordingly, the scope of protection is not limited by the description set out above, but is only limited by the claims which follow, that scope including all equivalents of the subject matter of the claims.

What is claimed is:

1. An apparatus for sealing a fluid flow, the apparatus comprising:

a cage member having an open end, a seal end, and a first fluid path extending through the cage member;

a seal plate having a seal plate contact surface and a second fluid path, the seal plate being removably coupled to the seal end of the cage member;

a seal member having a seal member contact surface, the seal member being reciprocally disposed within the first fluid path at the seal end of the cage member;

wherein the seal member is actuatable between an open position and a closed position;

wherein the first and second fluid paths are in fluid communication when the seal member is in the open position; and wherein the first fluid path is sealed from the second fluid path when the seal member is in the closed position, and the seal member contact surface contacts the seal plate contact surface to cause a seal.

2. The sealing apparatus of claim 1 wherein the seal between the seal member contact surface and the seal plate contact surface is a shear seal.

3. The sealing apparatus of claim 2 wherein the seal causes a substantially leak-free seal up to a pressure differential of 8,000 p.s.i. between the first and second fluid paths.

4. The sealing apparatus of claim 1 wherein the seal member contact surface and the seal plate contact surface are manufactured flat to at least 2 He lightbands.

5. The sealing apparatus of claim 4 wherein the seal member contact surface and the seal plate contact surface manufactured flat to at least 2 He lightbands cause a leak-free seal between the first and second fluid paths.

6. The sealing apparatus of claim 1 further comprising:

a cover plate having a third fluid path, the cover plate being removably coupled to the open end of the cage member such that the third fluid path communicates with the first fluid path; and a seal spring supported by the cover plate, extending through the first fluid path, and coupled to the seal member.

7. The sealing apparatus of claim 6 wherein the seal spring is configured to supply a pre-loading force to the seal member when the seal member is actuated from the open to the closed position.

8. The sealing apparatus of claim 6 wherein the seal spring maintains a force on the seal member acting at the point of contact between the seal spring and the seal member, and wherein the force acts at every position of the seal member between the open and closed positions.

9. The sealing apparatus of claim 6 wherein the seal spring comprises a snap-acting spring.

10. The sealing apparatus of claim 1 further comprising:

a first rod member reciprocally disposed within a first bore in the seal end of the cage member;

a second rod member reciprocally disposed within a second bore in the seal end of the cage member;

wherein the first rod member opposes the second rod member; and wherein the first and second rod members are configured to actuate the seal member between the open and closed positions.

11. The sealing apparatus of claim 10 wherein the first rod member has a smaller cross-sectional area than the second rod member.

12. The sealing apparatus of claim 10 further comprising:

a sleeve member having a longitudinal axis and an aperture extending through the sleeve member transverse to the longitudinal axis; and wherein the cage member extends through the aperture such that opposing ends of the aperture removably engage the first and second rod members.

13. The sealing apparatus of claim 10 wherein the sleeve member is hydraulically actuatable between an open and closed position corresponding to the open and closed positions of the seal member.

14. The sealing apparatus of claim 12 further comprising:

a housing;

a first piston supported by the housing;

a second piston supported by the housing and opposing the first piston;

wherein the sleeve member includes a first cylinder for receiving the first piston and a second cylinder for receiving the second piston; and wherein the sleeve member is reciprocally disposed between the first and second pistons.

15. The sealing apparatus of claim 14 wherein the first piston includes a first piston fluid path communicating with a first hydraulic fluid supply, and the second piston includes a second piston fluid path communicating with a second hydraulic fluid supply.

16. The sealing apparatus of claim 15 wherein the sleeve member is hydraulically actuatable between an open and closed position corresponding to the open and closed positions of the seal member.

17. The sealing apparatus of claim 16 further comprising a return spring tending to actuate the sleeve member to the open position.

18. The sealing apparatus of claim 15 further comprising a first piston seal disposed between the first piston and first cylinder, a second piston seal disposed between the second piston and second cylinder, and wherein the first and second piston seals seal the first and second hydraulic fluid supplies from the cage member, seal plate, seal member, cover plate, seal spring, first rod member, and second rod member.

19. An apparatus for sealing a fluid flow, the apparatus comprising:

a seal cartridge having a first opening, a second opening, and a fluid path extending from the first opening to the second opening;

a spring having a support end and a seal end, wherein the support end is supported by the seal cartridge, and wherein the spring extends into the fluid path;

a seal member coupled to the seal end of the spring; and wherein the seal member is reciprocally disposed adjacent the second opening between an open position and a closed position, and wherein the seal member seals the second opening from the fluid path in the closed position.

20. The sealing apparatus of claim 19 wherein the seal between the second opening and the fluid path is a shear seal.

21. The sealing apparatus of claim 20 wherein the seal causes a substantially leak-free seal up to a pressure differential of 8,000 p.s.i. between the second opening and the fluid path.

22. The sealing apparatus of claim 19 wherein the spring is configured to supply a pre-loading force to the seal member when the seal member is actuated from the open to the closed position.

23. The sealing apparatus of claim 19 wherein the spring maintains a force on the seal member acting at the point of contact between the spring and the seal member, and wherein the force acts at every position of the seal member between the open and closed positions.

24. The sealing apparatus of claim 19 wherein the seal spring comprises a snap-acting spring.

25. The sealing apparatus of claim 19 further comprising:

a first rod member reciprocally disposed within a first bore adjacent the second opening of the seal cartridge;

a second rod member reciprocally disposed within a second bore adjacent the second opening of the seal cartridge;

wherein the first rod member opposes the second rod member; and wherein the first and second rod members are configured to actuate the seal member between the open and closed positions.

26. The sealing apparatus of claim 25 further comprising:

a sleeve member having a longitudinal axis and an aperture extending through the sleeve member transverse to the longitudinal axis, the aperture having an inner surface; and wherein the seal cartridge extends through the aperture such that opposing ends of the inner surface of the aperture removably engage the first and second rod members.

27. An apparatus for testing a subterranean earthen formation, the apparatus comprising:

a cylindrical tool housing;

a formation probe assembly supported by the housing;

a valve supported by the housing, the valve comprising:

a seal cartridge comprising:

a housing having a first opening, a second opening, and a fluid path extending from the first opening to the second opening;

a spring having a support end and a seal end, wherein the support end is supported by the housing, and wherein the spring extends into the fluid path;

a seal member coupled to the seal end of the spring; and wherein the seal member is reciprocally disposed adjacent the second opening between an open position and a closed position, and wherein the seal member seals the second opening from the fluid path in the closed position; and a means for actuating the seal member between the open and closed positions;

a fluid port extending through the housing from the valve to the probe assembly; and wherein the fluid port and the fluid path are in fluid communication when the seal member is in the open position, and the fluid port is sealed from the fluid path when the seal member is in the closed position.

28. The formation testing apparatus of claim 27 wherein the seal cartridge is removably disposed within a bore formed in the tool housing, the bore comprising an inner surface having the fluid port therethrough.

29. The formation testing apparatus of claim 28 further comprising a plug having means to engage the inner surface of the bore such that when the plug is removably engaged with the inner surface of the bore, the seal cartridge is enclosed within the tool housing.

30. The formation testing apparatus of claim 29 wherein the plug engaging means comprises a set of threads configured to engage a set of mating threads on the inner surface of the bore.

31. The formation testing apparatus of claim 29 wherein the plug causes the seal cartridge to be removably secured within the tool housing such that the seal cartridge can be removed from the tool housing at the surface of a wellbore.

32. The formation testing apparatus of claim 27 wherein the valve seal member actuating means comprises:

a sleeve member supported by the tool housing and having an aperture therethrough, the aperture having an inner surface; and a plurality of reciprocating rod members supported by the seal cartridge housing and adjacent the seal member.

33. The formation testing apparatus of claim 32 wherein the seal cartridge extends into the aperture, wherein the rod members engage the seal member and the aperture inner surface, and wherein the sleeve member is actuatable between an open and a closed position, thereby actuating the seal member.

34. The formation testing apparatus of claim 33 wherein the sleeve member is hydraulically actuatable by way of a plurality of hydraulic fluid supplies supported by the tool housing.

35. The formation testing apparatus of claim 34 wherein the hydraulic fluid supplies are sealed from the seal cartridge.

36. A method for sealing a fluid flow, the method comprising:

directing a fluid flow through a seal cartridge, the fluid flow having a first direction;

supporting a spring such that the spring extends into the fluid flow;

pre-loading a seal member using the spring; and actuating the seal member between an open position and a closed position, wherein the fluid is allowed to flow through the seal cartridge when the seal member is in the open position and the fluid is sealed when the seal member is in the closed position; and wherein the seal member actuation is in a direction at least partially transverse to the fluid flow first direction.

37. The method of claim 36 further comprising:

disposing the seal cartridge within a bore formed in a valve housing, the bore comprising an inner surface having a fluid port therethrough; and actuating the seal member between the open and closed positions relative to the fluid port.

38. The method of claim 36 wherein the first actuating step further comprises:

disposing the seal cartridge within an aperture formed in a sleeve member, the aperture comprising an inner surface;

engaging the inner surface of the aperture with the seal member; and actuating the sleeve member between an open position and a closed position, thereby actuating the seal member.

39. The method of claim 38 wherein the spring comprises a snap-acting spring.

40. The method of claim 39 wherein the seal member actuating step comprises pushing the seal member slidingly along the inner surface of the bore until the spring snaps from the closed position to the open position.

41. The method of claim 40 wherein the seal member actuating step further comprises pushing the seal member until the spring snaps from the open position to the closed position.

42. The method of claim 36 further comprising providing a substantially leak-free seal when the seal member is in the closed position.

43. The method of claim 36 further comprising:

raising the seal cartridge to the surface of a wellbore; and replacing the seal cartridge with a new seal cartridge at the surface of the wellbore.

44. A method of testing a subterranean earthen formation, the method comprising:

directing a fluid flow through a tool string, through a seal cartridge and a fluid port, and adjacent a formation probe assembly having a probe, the seal cartridge and formation probe assembly being supported by the tool string;

supporting a spring in the seal cartridge such that the spring extends into the fluid flow;

pre-loading a seal member using the spring;

actuating the seal member from an open position relative to the fluid port to a closed position relative to the fluid port; and sealing the fluid flow from the fluid port and the formation probe assembly.

45. The method of claim 44 further comprising:

engaging the formation probe assembly;

extending the formation probe; and gathering formation data.

46. The method of claim 45 further comprising:

actuating the seal member from the closed position to the open position;

opening the fluid flow to the fluid port and the formation probe assembly;

equalizing the pressure in the formation probe assembly; and retracting the formation probe.

47. The method of claim 44 further comprising:

raising the tool string to the surface of a wellbore; and removing the seal cartridge from the tool string.

48. The method of claim 47 further comprising replacing the seal cartridge with a new seal cartridge.

* * * * *